United States Patent [19]

Matsui et al.

[11] Patent Number: 4,998,407

[45] Date of Patent: Mar. 12, 1991

[54] METHOD AND APPARATUS FOR PRODUCING YARN

[75] Inventors: Isamu Matsui; Masao Uehara, both of Kyoto; Shoji Sakai, Nagaokakyo; Koshi Noda, Joyo; Yasuhiko Kubota, Kyoto, all of Japan

[73] Assignee: Murata Kikai Kabushiki Kaisha, Kyoto, Japan

[21] Appl. No.: 378,148

[22] Filed: Jul. 11, 1989

[30] Foreign Application Priority Data

Jul. 11, 1988 [JP] Japan ..... 63-172162

[51] Int. Cl.[5] ..... D01H 09/18

[52] U.S. Cl. ..... 57/328; 57/281

[58] Field of Search ..... 57/281, 328, 293; 19/287, 288

[56] References Cited

U.S. PATENT DOCUMENTS

| | | | |
|---|---|---|---|
| 2,187,830 | 1/1940 | Jones | 19/287 |
| 4,055,039 | 10/1971 | Movshovich et al. | 57/293 |
| 4,484,436 | 11/1984 | Nakayama et al. | 57/328 |
| 4,761,946 | 8/1988 | Stahlecker | 57/328 |
| 4,785,619 | 11/1988 | Stahlecker et al. | 57/328 X |
| 4,819,422 | 4/1989 | Stahlecker et al. | 57/328 |
| 4,831,816 | 5/1989 | Stahlecker | 57/328 |
| 4,848,076 | 7/1989 | Ueda et al. | 57/281 |
| 4,854,523 | 8/1989 | Stahlecker et al. | 57/328 X |

*Primary Examiner*—Stuart S. Levy
*Assistant Examiner*—Steven M. DuBois
*Attorney, Agent, or Firm*—Spensley Horn Jubas & Lubitz

[57] ABSTRACT

Method and Apparatus for forming a package including a steps of drafting and twisting a raw sliver to form a spun yarn, taking up at least two spun yarns in a paralleled state into the same package, and supplying the thus wound package directly to a two-for-one twister disposed in continuity with the spinning device. The spinning device and the two-for-one twister are connected to each other by a conveyor for feeding the packages from the spinning device and by a yarn supply package replacing device.

11 Claims, 7 Drawing Sheets

METHOD AND APPARATUS FOR PRODUCING YARN

FIELD OF THE INVENTION

This invention relates to a method and apparatus for producing a yarn comprising at least two spun yarns paralleled with each other, with sufficient twisting of the yarn.

RELATED ART STATEMENT

A spun yarn produced by a ring spinning frame or other innovative spinning frame (open-end spinning frame, pneumatic type spinning frame, etc.) is often subjected to after-treatments. Namely, at least two such spun yarns may be doubled through being rewound in a paralleled state by a doubler, for the purpose of removing unevenness of fineness of the yarn, uniformizing the twisting torque applied at the time of spinning, or the like. The yarn obtained by the doubler may be twisted by a two-for-one twister to increase the yarn strength, or subjected to twisting-in of fluff to be a yarn with a very smooth surface.

The yarn as produced by the spinning frame, often, cannot be an excellent yarn having sufficient strength and little fluff and suitable for use in weaving or knitting steps until the yarn is treated by the above-mentioned after-treatment process.

The after-treatment process, however, comprises a large number of steps such as a step of first conveying the yarns spun by the spinning frame to the doubler, a step of doubling the spun yarns by the doubler, a step of conveying the doubled yarn to the two-for-one twister, and a step of twisting the doubled yarn by the two-for-one twister. Thus, the after-treatment process inevitably requires a lot of man power and process time, or a large number of conveyors in place of the man power. In the case of using the man power, particularly, there is the possibility of the wound form of the yarn becoming out of shape or the yarn being stained due to the contact of the operator with the surface of the package. Therefore, there has been quested for simplification of the above-mentioned steps and for solutions of the above-mentioned problems.

Besides, where the spinning frame is a ring spinning frame, for the removal of the yarn defects there is need for a step of rewinding by an automatic winder so as to make the wound form of the yarn suitable for the subsequent doubling step or two-for-one twisting step; thus, the process involves still more elements.

As a device proposed for the simplification of the process mentioned above, for example, there is a device in which a combination of packages delivered from an automatic winder and arranged in upper and lower stages is used as a yarn supply package for a two-for-one twister in order to perform both twisting and doubling on the two-for-one twister.

According to the device just mentioned above, a step of doubling by a doubler is omitted, but there is a need for the yarn supply package for the two-for-one twister to assume the special form in which the packages delivered from the winder are stacked in two stages. Thus, there arises another problem that replacement of the yarn supply packages involves troublesome operations or, due to the difference between the tension of undoing from the upper package and the tension of undoing from the lower package, yarn end breakage will frequently occur in the two-for-one twisting step.

OBJECT AND SUMMARY OF THE INVENTION

It is an object of the present invention to provide a method and an apparatus for producing a yarn whereby the above-mentioned after-treatment process is simplified.

The method of an embodiment of the present invention comprises, in a spinning device, drafting and twisting a raw sliver to form a spun yarn, taking up at least two spun yarns in a paralleled state into the same package, and supplying the thus wound package directly to a two-for-one twister disposed in continuity with the spinning device. The apparatus for forming a yarn according to this invention comprises a spinning device for drafting and twisting a raw sliver to form a spun yarn and taking up at least two spun yarns in a paralleled state into the same package, and a two-for-one twister, the spinning device and the two-for-one twister connected to each other by a conveyor for feeding the spun packages delivered from the spinning device and by a yarn supply package replacing device.

Figure 10:
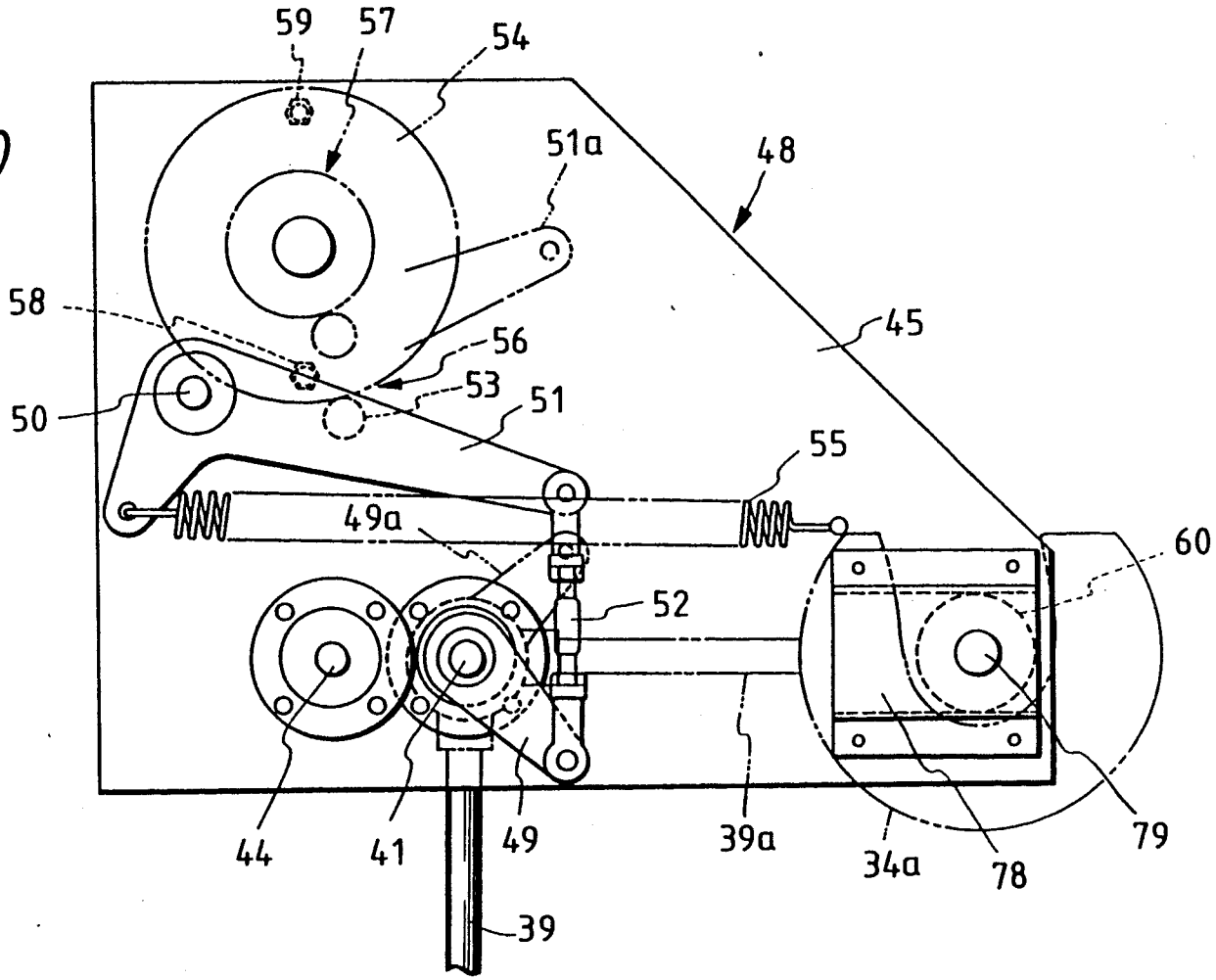
Figure 12:
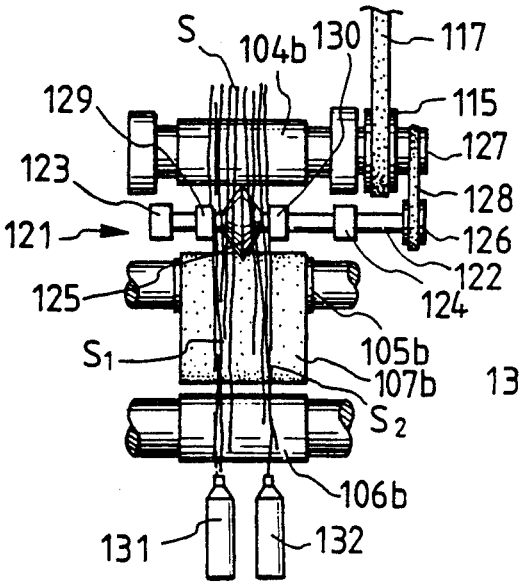
Figure 13:
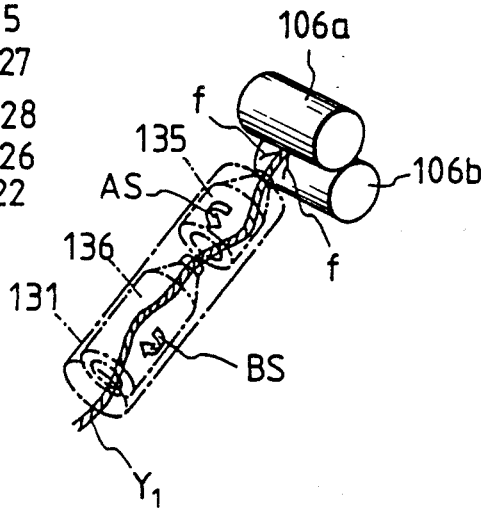
Figure 14:
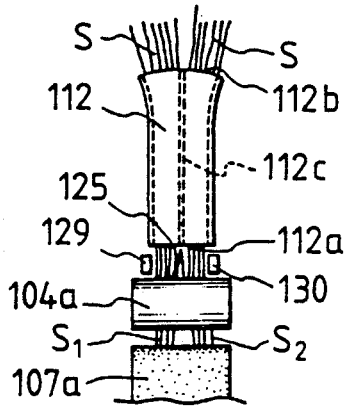
Figure 11:
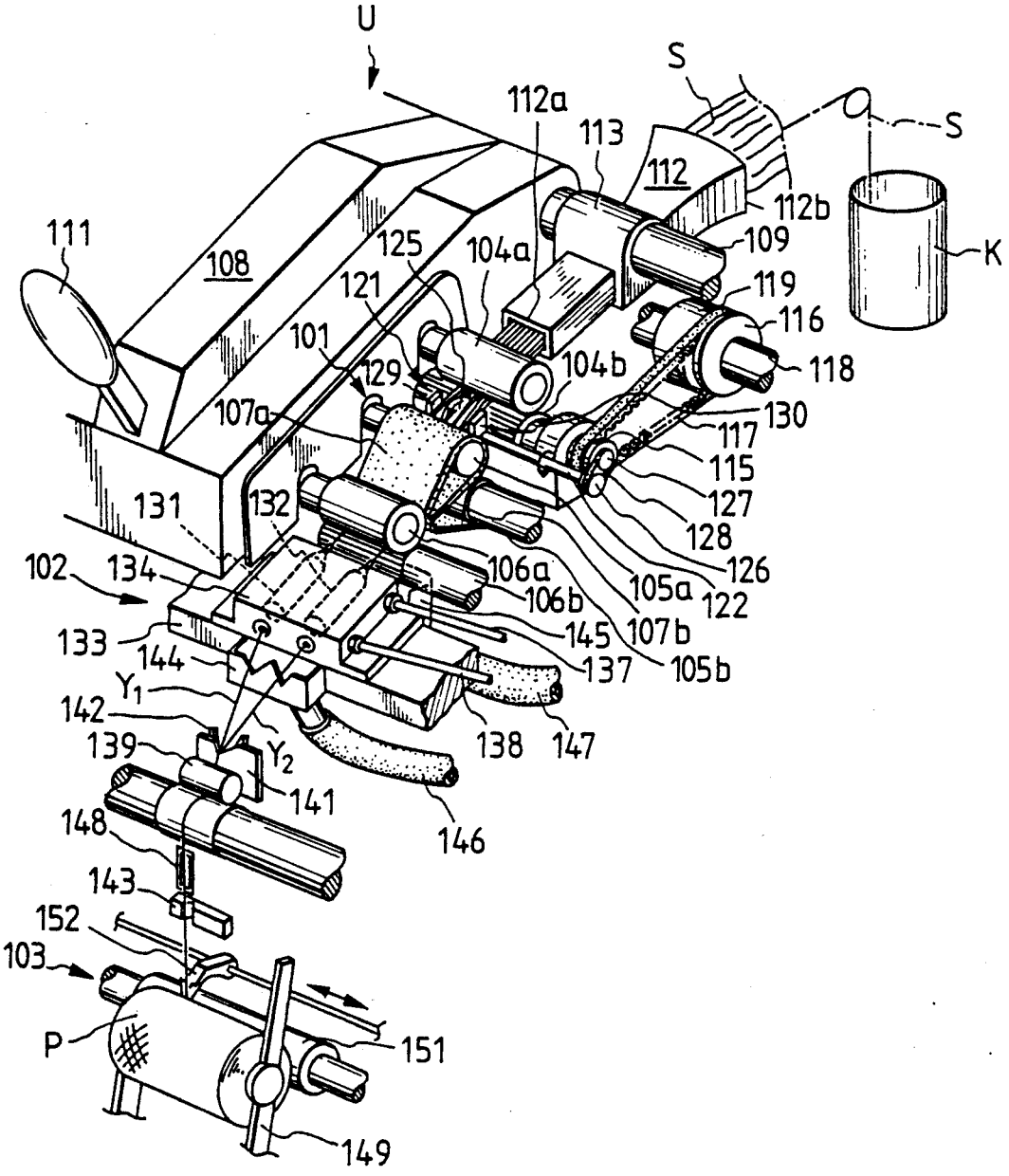

FIG. **9*a*** is an illustration of the condition at the raised position of the receiver member;

FIG. **9*b*** is an illustration of the condition at the lowered position of the receiver member;

FIG. 10 is a plan view of a driving system comprising a spline shaft and a screw rod;

FIG. 11 is a perspective view of one unit of a spinning frame;

FIG. 12 is a plan view of a drafting device, shown with top rollers omitted;

FIG. 13 is a perspective view of a spinning mechanism by a twisting device;

FIG. 14 is a plan view of another example of a separation guide device; and

Figure 15:
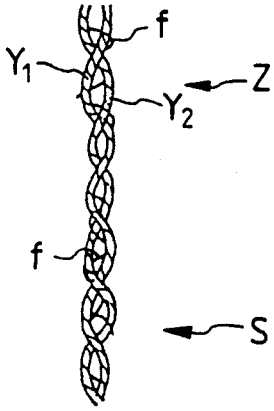

FIG. 15 is an illustration of the structure of a doubled spun yarn produced.

DETAILED DESCRIPTION OF PREFERRED EMBODIMENTS

Working examples of this invention will now be explained below while referring to the drawings.

Figures 1, 2:
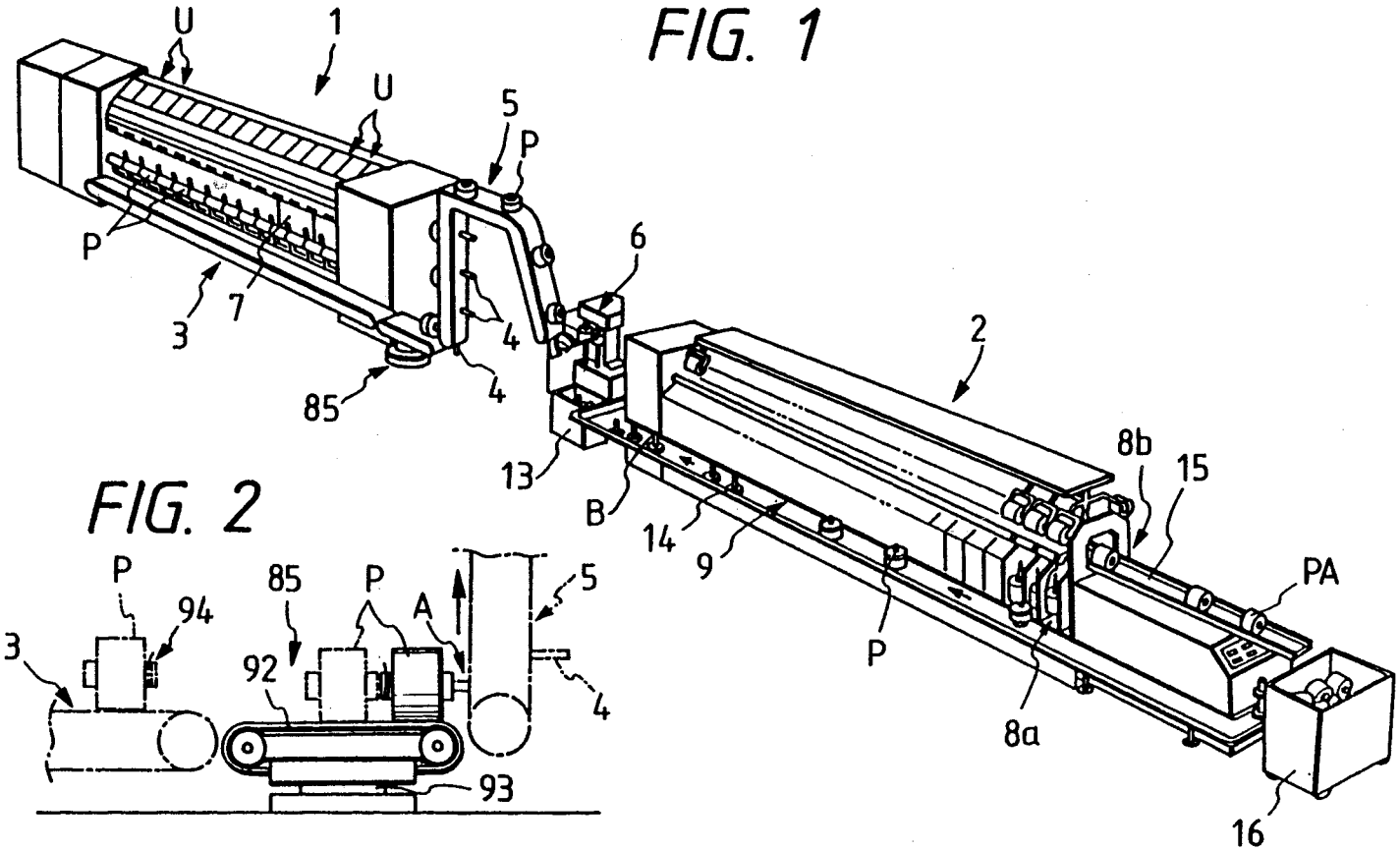
FIG. 1 is a perspective view of the entire body of the device for producing a yarn according to an embodiment of this invention.
FIG. 2 is a side view of a transfer device.

FIG. 1 is a perspective view of the entire body of a device for producing a yarn according to an embodiment this invention. In the figure, a so-called pneumatic-type spinning frame 1, in which a drafted raw sliver is twisted by air jets to form a spun yarn, a two-for-one twister 2 are connected to each other by a feeding conveyor 3 comprising a belt conveyor moved just in front of the spinning frame 1, a gate conveyor 5 provided with pegs 4 and disposed following the feeding conveyor 3, and a yarn supply package replacing device 6.

The pneumatic-type spinning frame 1 comprises a plurality of spinning units U. A package P having a predetermined length of yarn produced by each of the units U is delivered onto the conveyor 3 by pushing open a cradle of a winder by an automatic doffing car truck 7 capable of moving along the unit U, whereby the package is doffed.

The spinning unit U comprises a drafting device 101, described in detail below, a twister 102 for twisting the drafted sliver S by air jets, and a take-up device 103 for taking up the spun yarn.

On the other hand, the two-for-one twister 2 connected to the spinning frame 1 comprises a multiplicity of spindles 8*a*, 8*b* arranged in parallel and back to back, with a yarn supply package feeding conveyor 9 laid in a closed loop around a machine base. On the conveyor 9, the yarn supply packages P and blank yarn supplies, namely, bobbins B emptied completely of yarn and remaining erected on a tray in the empty state are fed in a mixed state. On the spindle with full packages, the delivery of the full packages PA and the replacement of the blank yarn supplies in the spindle with the yarn supply packages P on the conveyor 9 are carried out by the operator or an operating robot, and then winding is restarted.

Between a feeding conveyor 3 and gate conveyor 5 disposed next to the spinning frame 1 and the two-for-one twister 2, there is disposed a yarn supply replacing device 6, described below, by which the blank yarn supplies B fed on the conveyor 9 are removed from package feeding mediums (hereinafter referred to as tray 14), and the full packages P fed from the spinning frame 1 are supplied and fitted in position on the tray 14. Numeral 13 denotes an empty-bobbin box for containing the empty bobbins removed from the trays 14.

In FIG. 1, the full packages PA doffed from the two-for-one twister 2 are delivered onto a conveyor belt 15 moved between the spindles arranged back to back, and are contained into a package container car truck 16 provided at the side of the machine base.

In this working example, a combination of one spinning frame with one two-for-one twister connected to each other is shown It is possible, however, to connect one spinning frame with a plurality of two-for-one twisters, or a plurality of spinning frames with one two-for-one twister, or a plurality of spinning frames with a plurality of two-for-one twisters, by a common feeding line, in order to balance the production volumes.

In the working example as described above, it is possible for the operator to pass under the gate conveyor 5 between the spinning frame 1 and the two-for-one twister 2, and it is possible to accumulate a plurality of packages on the gate conveyor 5, thereby providing a buffer function between the volume of production of the packages by the spinning frame 1 and the process time of the two-for-one twister 2.

Figure 3:
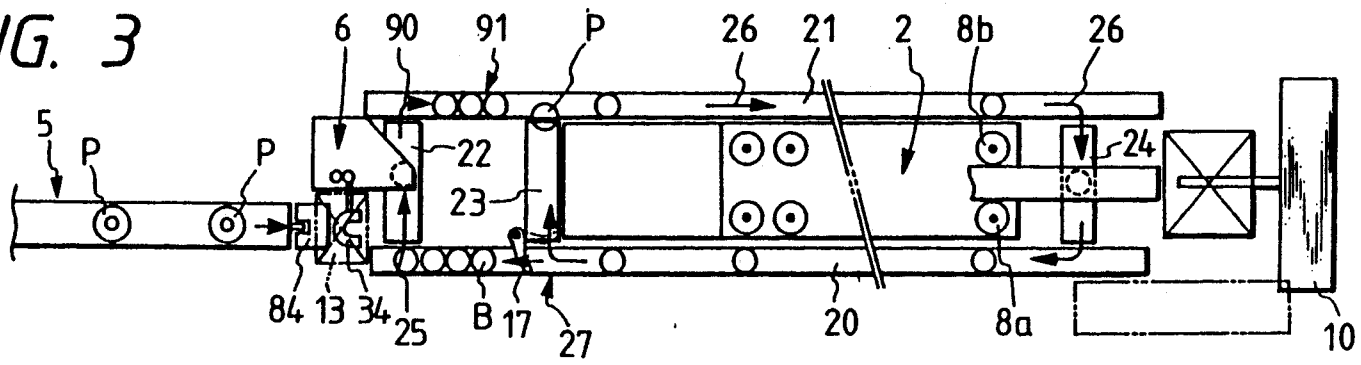
FIG. 3 is a schematic plan view of a two-for-one twister.
Figure 4:
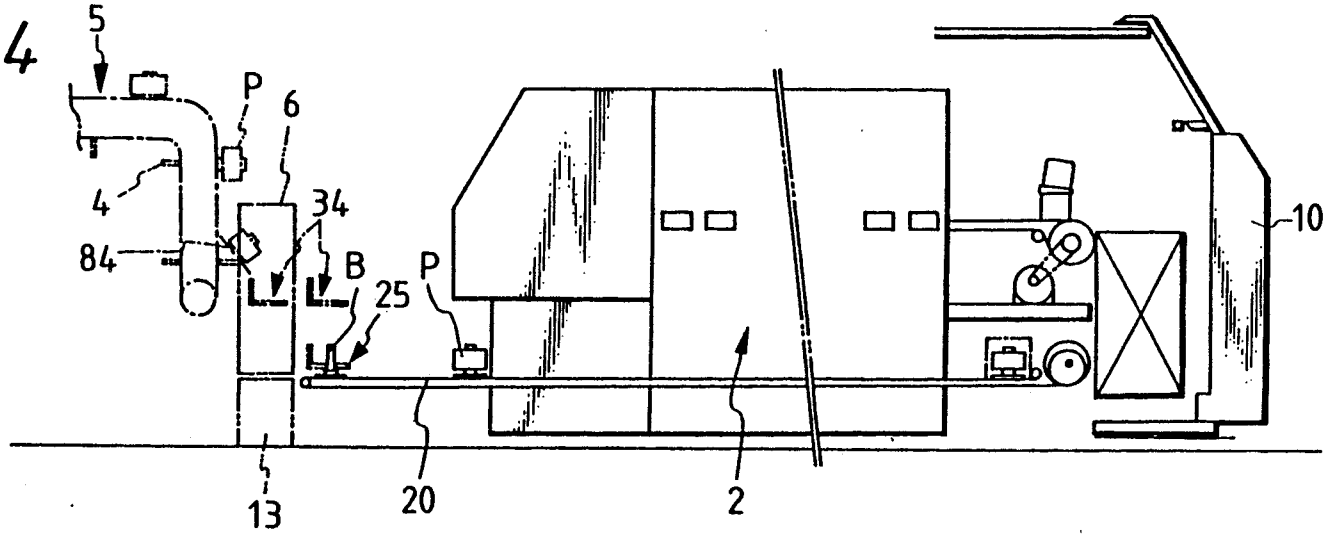
FIG. 4 is a side view of the same.

FIGS. 3 and 4 shows an arrangement of a car truck type automatic doffing robot 10 in the system shown in FIG. 1. Namely, conveyors 22, 23, 24 are laid between conveyors 20, 21 laid along the spindles 8*a*, 8*b* in the two-for-one twister 2, and a yarn supply replacing station 25 is provided at an intermediate portion of the conveyor 22. Therefore, the full-wound yarn supplies P and the blank yarn supplies B coexist in the yarn supplies fed on the conveyors 21, 24, 20 in the direction of arrow 26. At a branching point 27, the full-wound yarn supplies P and the blank yarn supplies B are discriminated from each other by a known feeler, photoelectric switch or the like for detecting the presence or absence of a yarn layer on the bobbin. Only the full-wound yarn supplies are transferred onto the conveyor 23 by switching a point, whereas the blank yarn supplies B are fed straight ahead on the conveyor 20 and transferred to the bypassing yarn supply replacing station 25.

The switch gear for the point may be a lever device 17, shown in FIG. 3, which is operated to swivel by the feeler serving as the discriminator for the full-wound yarn supplies P and the blank yarn supplies B.

Figure 5:
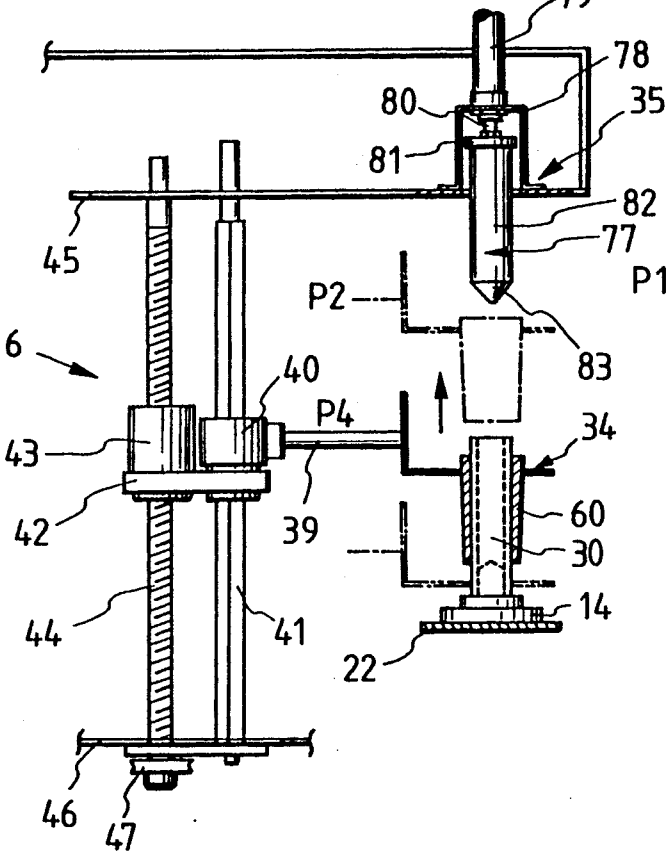
FIG. 5 is a side view of a yarn supply replacing device.

The yarn supply replacing device 6 will now be explained referring to FIGS. 5 to 10. In FIG. 5, the replacing device 6 comprises a package receiver member 34 capable of sliding vertically and of swiveling, and a guide device 35 for positioningly guiding the package at the time of fitting the package to a cylindrical support member 30 on the tray.

Figure 8:
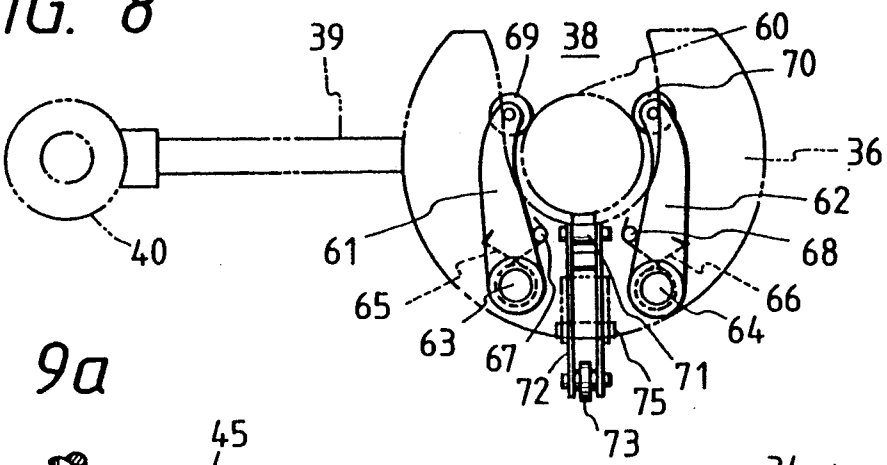
FIG. 8 is a plan view of a bobbin-gripping device provided at a bottom portion of a receiver member.
Figure 9B:
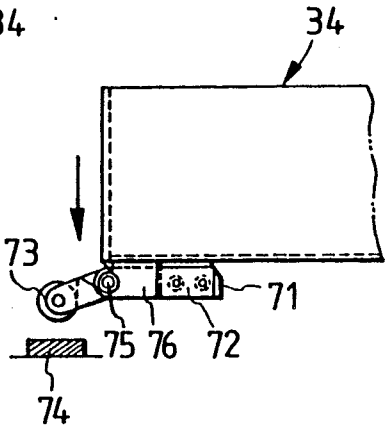
Figure 9A:
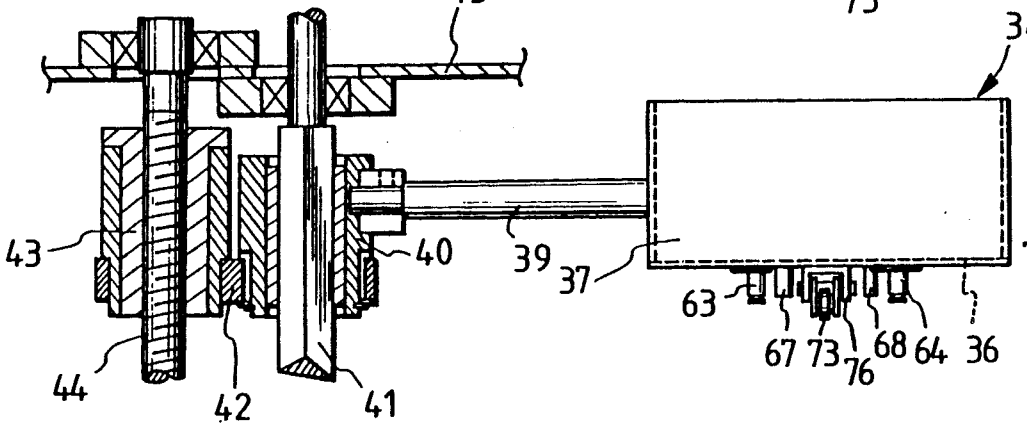

The package receiver member 34 is, as shown in FIGS. 8 and 9, a boxlike body which comprises a substantially circular bottom plate 36 for supporting thereon an end face of the yarn layer of the package, and a side wall 37 continuous with the bottom plate 36, with the side wall and a groove 38 formed in the bottom plate 36 being opened on one side in a substantially U shape in plan view.

One end of an arm 39 is attached to the side wall 37 of the package receiver member 34, and the other end of the arm 39 is attached to a side portion of a boss 40. The boss 40 is so supported that it can be moved only vertically relative to a spline shaft 41 and can be rotated in a body with the shaft 41 relative to a liftable body 42. A nut body 43 is fixed to the lift body 42, and the liftable body 42 and the boss 40 rotatably supported thereon are lifted up and lowered by the rotation of a screw rod 44 engaged with the nut body 43. Namely, as shown in FIG. 5, the screw rod 44 is borne between upper and lower frames 45 and 46 and rotated forward and reversely by a pulley 47 fixed to the lower end thereof and a motor, not shown, whereby the liftable body 42 and, hence, the receiver member 34 are lifted up and lowered. A proximity switch is disposed at each stop position to detect a portion of the liftable body 42, whereby stop control is performed.

The swiveling of the arm 39 is effected by the spline shaft 41 and the boss 40 engaged therewith. A driving mechanism 48 for the spline shaft 41 is shown in FIG. 10. Namely, a lever 49 is keyed on the top end of the spline shaft 41, and a rod 52 is connected between the lever 49 and a cam lever 51 pivoted on a fixed shaft 50. A cam follower 53 is supported on an intermediate portion of the cam lever 51, and is pressed by the force of a spring 55 against a cam plate 54 driven by a motor. The cam plate 54 is provided with a maximum-radius cam surface 56 and a minimum-radius cam surface 57 with a 180° phase difference therebetween. Therefore, as the cam lever 51 is turned between the solid-line position and the two-dotted chain line position 51*a*, the lever 49 fixed to the spline shaft 41 is moved between the solid-line position and the two-dotted chain line position 49*a*. In this working example, the solid-line position of the lever 49 is a position at which the receiver member 34 receives the package from the spinning frame side and at which the empty bobbin held by the receiver member 34 is released. On the other hand, when the lever 49 in the two-dotted chain line position 49*a*, the receiver member 34 is at the two-dotted line position 34*a* in FIG. 10, at which the empty bobbin on the positioned tray 14 is gripped, and the package on the receiver member 34 is supplied onto the tray 14. The angle between the position 49 and the position 49*a* is 90°. Numerals 58 and 59 denote proximity switches for detection of the 180° rotational positions of the cam plate 54, whereby the swiveling of the arm is momentarily stopped when an end face of a large radius portion of the cam plate is detected.

The receiver member 34 is, as shown in FIG. 8, provided with the groove 38 in the bottom plate 36 so as to permit relative entrance of the bobbin 60. On the opposite sides of the groove 38, a pair of empty bobbin gripping pieces 61, 62 are supported on the lower side of the bottom plate 36 through shafts 63, 64. The empty bobbin gripping pieces 61, 62 are biased in the directions for gripping the empty bobbin 60, by coil springs 65 and 66 wound around the shafts 63 and 64, respectively, and are limited in position upon making contact with stoppers 67 and 68, respectively. Rollers 69 and 70 are supported at the tips of the gripping pieces 61 and 62, for gripping the empty bobbin therebetween.

At a position corresponding to the deepest portion of the groove 38, a pressing piece 71 for gripping and releasing of the empty bobbin is screwed to an end of a lever 72. As shown in FIG. 9*b*, when a cam roller 73 provided at an end portion of the lever 72 supported on a shaft 75 of a bracket 76 is engaged with a cam piece 74 provided on the fixed frame side corresponding to the vicinity of a most lowered position of the receiver member 34, the pressing piece 71 integral with the lever 72 is turned clockwise on the shaft 75. Consequently, of the three-point gripping of the empty roller, namely, the gripping of the bobbin at three points by the rollers 69, 70 and the pressing piece 71 in FIG. 8, the gripping by the pressing piece 71 is released, whereby the empty bobbin 60 is permitted to fall.

Figure 7:
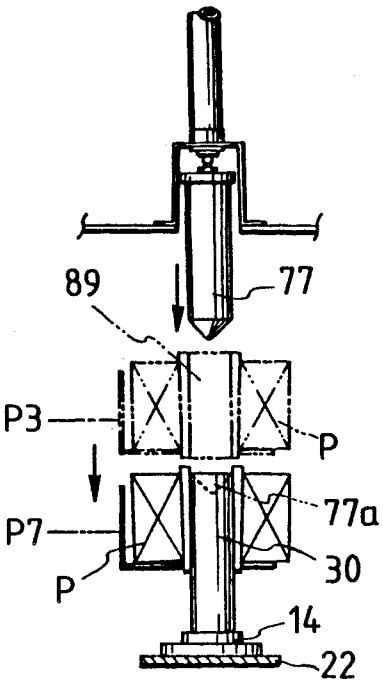
FIG. 7 is an illustration of the step of fitting a package.

Furthermore, in FIG. 5, a guide rod 77 for the package located on the axis line of the support member 30 is liftably provided on the upper side of the tray 14 at the yarn supply replacing position. Namely, the guide rod 77 provided with a flange portion 81, a cylindrical portion 82 and a conical portion 83 in a body is attached to a piston rod 80 in a fluid cylinder 79 disposed on a fixed frame 78. As shown in FIG. 7, the guide rod 77 is vertically moved between a waiting position 77 and a most lowered position 77*a* indicated by the two-dotted chain line, by the action of the cylinder 79. When the guide rod 77 is located in the most lowered position, the conical portion at the lower end of the guide rod 77 enters a little into the top aperture of the cylindrical support member 30.

The operation of the above-mentioned yarn supply package replacing device will now be explained below referring to FIGS. 5 to 10.

First, in the layout showing in FIGS. 3 and 4, the blank yarn supply B is stopped and positioned at the replacing station 25.

The yarn supply replacing operation is constituted of two steps: a first step of removing the empty bobbin 60 on the tray 14, and a second step of fitting the package P delivered from the spinning frame to the support member 30.

Namely, in the first step, the receiver member 34 is swiveled 90° counterclockwise in plan view at the waiting position at a height P4, and grips the empty bobbin 60*b* on the tray 14 by the gripping pieces 61, 62. Next, the receiver member 34 is moved upward to a height P2, where it removes the empty bobbin 60*b* from the support member 30, is again swiveled 90°, clockwise this time, and is lowered to the most lowered position P8. As shown in FIG. 9*b*, the cam piece 74 is provided at the lowermost position, and releases the pressing piece 71, so that the empty bobbin 60*b* having been gripped is dropped to be contained in the box (13 in FIGS. 1 and 3) below.

Figure 6:
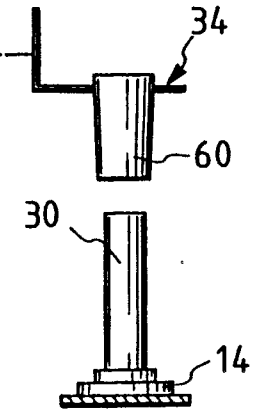
FIG. 6 is an illustration of the condition where a bobbin is removed.

Next, in the second step, the receiver member 34 having received the full package, to be fitted next, from the gate conveyor 5 at a height P1 in FIG. 6 is lowered to a position P3 in FIG. 7, is then swiveled counterclockwise in plan view, and is stopped for a predetermined period of time at a package fitting position on the upper side of the tray 14. During the period, the guide rod 77 shown in FIG. 7 is lowered to the two-dotted chain line position in FIG. 7, where the lower end of the guide rod 77 enters a little into the support member 30. In this case, the guide rod 77 is lowered through a central hole 89 in the package P being waiting in FIG. 7, so that the central hole 89 of the package and the support member 30 are positionally corrected to be aligned coaxially. The support member 30 is erected by being fitted on a peg at the center of the tray 14. Therefore, the receiver member 34 is then lowered to a position P7, and the full package P is positioned as shown in FIG. 7. Furthermore, the receiver member 34 is reversely swiveled clockwise in plan view, whereby the package P and the receiver member 34 are separated from each other due to opening of the gripping pieces 61, 62, and the package P fitted on the support member 30 is dropped by gravity to an appropriate position on the tray.

Subsequently, the receiver member 34 is moved upward to the most raised position P1, whereby supply of the package is completed.

As described above, the yarn supplies are replaced at the yarn supply replacing station 25 in FIG. 3, the tray 14 with the full package P mounted thereon are transferred in the direction of arrow 90, is once reserved 91, and then fed out so that the intervals between the yarn supplies on the conveyor 21 are substantially equal. The yarn supplies circulated around the two-for-one twister are replaced with blank yarn supplies on the spindles, by the operator or by the car truck type automatic doffing robot 10 or the like.

At the final end of the gate conveyor 5 is provided a chute 84 for promoting the slip-off of the package P from the peg 4, thereby smoothening the delivery of the package P to the receiver member 34. The chute 84 comprises a plate member provided at the center thereof with a slit permitting the peg 4 to pass therethrough (FIGS. 3 and 4).

Thus, the supply of the full packages from the gate conveyor 5 to the yarn supply package replacing device 6 and the replacement of the yarn supplies to the two-for-one twister by the yarn supply package replacing device 6 are carried out. In this working example, a transfer device 85 for changing the pose of the package P is provided between the feeding conveyor 3 in front of the spinning frame 1 and the gate conveyor 5. The transfer device 85 will now be explained below.

The transfer device 85 comprises, as shown in FIG. 2, a belt conveyor 92 and a swiveling driver 93 for driving the conveyor 92 as a whole to swivel about a vertical axis, and operates as follows.

After the package P fed on the feeding conveyor 3 is transferred onto the belt conveyor 92 shown in FIG. 2, the belt conveyor 92 is moved by a slight amount to bring the package P to a substantially central position on the belt conveyor 92 (as indicated by the two-dotted chain line in FIG. 2). Next, the swiveling driver 93 is driven so that the package P, together with the belt conveyor 92, is swiveled 180° about the vertical axis. By the swiveling, the direction of the package P is reversed 180°. Then, the belt conveyor 92 is again moved to transfer the package P located at the center toward the gate conveyor 5. During the swiveling of the belt conveyor 92, the gate conveyor 5 is intermittently moved to bring a vacant peg 4 to the position A in FIG. 2. Therefore, the above-mentioned movement of the belt conveyor 92 causes the package P to be fitted onto the vacant peg 4.

The reversion of the direction of the package P is a process for ensuring that the position of a bunch 94 on the package P delivered from the spinning frame 1 is on the upper side in the two-for-one twister 2 after the feeding of the package P. When the position of the bunch 94 on the package P doffed from the spinning frame 1 is reverse to that in the above example, the transfer device 85 may not be indispensable, and the feeding conveyor 3 of the spinning frame 1 may be connected directly to the starting end of the gate conveyor 5.

Besides, the transfer device 85 as mentioned above employs an ordinary belt conveyor 92, and, accordingly, the peg 4 and the belt conveyor 92 would interfere with each other if the gate conveyor 5 is moved in the condition shown in FIG. 2. To avoid the interference, the about 90° swiveling of the belt conveyor 92 around the vertical axis is required for moving the gate conveyor 5. On the other hand, when a belt conveyor bisected in the center so as to permit the peg 4 to pass therethrough in the condition shown in FIG. 2 is used, it is possible to move the gate conveyor 5 irrespectively of the direction of the belt conveyor 92. Namely, a conveyor comprising two endless-looped belts moved on both sides or the like conveyor may be used.

The spinning frame 1 in this working example will now be explained below. Since the spinning units U are the same in construction, the following explanation will be made of one of the units U.

FIG. 11 is a perspective view of one spinning unit U, which comprises a drafting device 101 for drafting the sliver S supplied from a can K, a twisting device 102 for twisting the sliver S drafted by the drafting device 101 to form a spun yarn, and a take-up device 103 for taking-up the spun yarn.

Each of the devices 101, 102 and 103 will be explained below referring to FIGS. 11 to 14.

The drafting device 101 comprises a pair of back rollers 104*a*, 104*b*, a pair of middle rollers 105*a*, 105*b*, and a pair of front rollers 106*a*, 106*b*, with the circumferential velocity becoming higher in that order. The middle rollers 105*a*, 105*b* are provided with apron belts 107*a*, 107*b*.

Numeral 108 denotes a cradle for supporting the top-side rollers 104*a*, 105*a*, 106*a* of the rollers, which cradle is capable of swiveling freely around a support shaft 109 fixed on a frame. Numeral 111 denotes a lever for lifting up the cradle 108, and numeral 112 denotes a sliver guide fitted to the support shaft 109 through a bracket 113. The sliver guide 112 has an outlet 112*a* shaped in a horizontally elongate flat form so that the sliver S can be fed to the back rollers 104*a*, 104*b* in a slightly horizontally elongate cross-sectional shape.

Of the rollers 104*a*, 105*a*, 106*a*, 104*b*, 105*b* and 106*b*, the bottom-side rollers 105*b*, 106*b* of the middle and front rollers are provided as line shafts penetrating through all the units so that the middle and front rollers are rotated by driving the line shafts. Of the back rollers 104*a*, 104*b*, the bottom-side roller 104*b* is independent on a unit basis, and is rotated through connection thereto of a line shaft 118 via toothed pulleys 115, 116 and a toothed belt 117. The toothed pulley 116 is intermediated by an electromagnetic clutch 119, and the start and stop of rotation of the back rollers 104*a*, 104*b* are controlled on a unit basis by engagement and disengagement of the clutch 119.

In this working example, between the back rollers 104*a*, 104*b* and the middle rollers 105*a*, 105*b* is provided a sliver separation guide device 121 as follows.

As shown in FIG. 12, another shaft 122 is borne 123, 124 between the back rollers 104*a*, 104*b* and the middle rollers 105*a*, 105*b*. A rotating body 125 substantially rhombic in vertical section is fixed to the shaft 122, and a toothed pulley 126 fixed to an end of the shaft 122 is connected by a belt 128 to a toothed pulley 127 fixed to the pulley 115 so that the rotating body 125 is rotated between the back rollers 104*a*, 104*b* and the middle rollers 105*a*, 105*b*, at substantially the same speed and in the same direction as the back rollers 104*a*, 104*b*.

The rotating body 125 is located at the center in the width direction of a passage for the sliver S, and a peripheral edge portion of the body 125 is located to penetrate the passage for the sliver S to protrude upward, thereby separating the sliver S coming from the back rollers 104*a*, 104*b* into two rows $S_1$, $S_2$ equal in width.

On the left and right sides of the rotating body 125, guide blocks 129 and 130 are respectively fixed to the frame, for restricting the lateral spreading of the two rows of slivers $S_1$ and $S_2$.

Therefore, the two rows of slivers $S_1$, $S_2$ separated at the position of the rotating body 125 are drafted while maintaining the state of the two parallel rows even at the position of the middle rollers 105*a*, 105*b* and the position of the front rollers 106*a*, 106*b* on the downstream side, and are introduced into air jet nozzles 131, 132, described later.

The position of the rotating body 125 may be between the back rollers 104*a*, 104*b* and the sliver guide 112. In that case, when the sliver guide 112 is provided therein with a partition wall 112*c* for partitioning the interior of the guide 112 into left and right chambers, as shown in FIG. 14, so that the sliver S is introduced by being already separated into two rows at the position of an inlet 112*b* to the sliver guide 112, the separation of the two rows of the slivers is performed favorably. Namely, in that case, the sliver is already separated into two rows in the single can K, or two rows of slivers are supplied from two cans.

A fixed separation guide member may be used in place of the above-mentioned rotating body 125. In the case of using the fixed guide, however, there is the possibility that the fibers constituting the sliver S fed through the drafting device 101 at a predetermined velocity may be bent by making contact with the fixed guide member, resulting in formation of the so-called hooked fiber. Therefore, the sliver separation guide device 121 is preferably a moving body such as the above-mentioned rotating body 125 moved at a speed approximately equivalent to the velocity of the sliver S at the relevant position.

The twisting device 102 will now be explained. The twisting device 102 in this example comprises, in a housing 134 fixed to a frame 133, two parallel rows of air jet nozzles 131, 132 each comprising two air nozzles 135, 136 disposed in series (hereinafter, the air nozzle on the upstream side will be referred to as the first nozzle 135 and the air nozzle on the downstream side will be referred to as the second nozzle 136). The air jet nozzles 131, 131 have the function of twisting independently the slivers $S_1$, $S_2$ supplied, to form spun yarns $Y_1$, $Y_2$.

Since the air jet nozzles 131, 132 are the same in mechanism, only one of them will be explained below.

As shown in FIG. 13, the first and second nozzles 135, 136 are each provided with a plurality of minute air jet holes (not shown) for jetting air in the tangential directions toward the interior of the passage for the sliver S bored along the center axis of the nozzle. By the minute air jet holes, air flows swirling in the opposite directions of arrows AS and BS are generated in the passage. Numerals 137 and 138 denote pipes for supplying pressurized air into the first nozzle 135 and the second nozzle 136, respectively.

The spinning process by the air jet nozzles 131, 132 is conducted as follows.

The sliver S introduced into the passage is twisted by the swirling airflow BS in the relevant direction, and the false twist is propagated to the vicinity of the nipping point of the front rollers **106*a*, 106*b***.

The sliver S coming from the front rollers **106*a*, 106*b* is bundled by the false twisting effected by the second nozzle 136. Between the front rollers 106*a*, 106*b* and the first nozzle 135, on the other hand, the sliver S is ballooned under the function of the first nozzle 135 in the direction opposite to the direction of the false twist. The ballooning causes generation of fibers (open-end fibers) f which are freed at the leading end thereof though the another rear ends thereof are still gripped by the front rollers 106*a*, 106*b* to be among the fibers constituting the sliver. The ballooning in the direction opposite to the false twist between the front rollers 106*a*, 106*b* and the first nozzle 135 and the airflow AS created by the first nozzle 135 cause the fibers f to be wound in the direction opposite to the direction of the false twisting effected by the second nozzle 136. In the process of the undoing of the false twist through the second nozzle 136**, the fibers f are wound increasingly firmly around the core fiber bundle in the direction opposite to the inserted false twist and in a sufficient number of winds, to form the so-called bound spun yarn.

The spun yarns Y coming out of the air jet nozzles 131, 132 are drawn out by a delivery roller 139, while the two yarns are paralleled and doubled at the position of a guide plate 141 disposed on the immediate upstream of the delivery roller 139, and the doubled yarn is wound by a take-up device 103 described later.

Therefore, the two rows of the air jet nozzles 131, 132 may be nonparallel, and may be arranged in a V-shaped layout with each of the rows on the line connecting between the position of the guide plate 141 (doubling position) and the sliver outlet position of the front rollers **106*a*, 106*b*. Alternatively, the first nozzles 135, 135 may be parallel to each other, with only the second nozzles 136, 136 being directed to the position of the guide plate 141** (doubling position).

Numeral 142 denotes a cutter provided at the position of the guide plate 141. The cutter 142 is operated by a yarn defect detection signal from a slub catcher 143 provided in the yarn path, extending down to the winding device 103 by way of the delivery roller 139, for detecting a defective portion of the yarn.

Numerals 144 and 145 each denote a suction port for dust such as yarn waste, fly waste, etc., and numerals 146 and 147 each denote an air suction pipe.

Numeral 148 denotes a suction pipe for removal of slack present in the yarn, called a slack tube, which sucks the yarn spun through the air jet nozzles 131, 132 at the time of starting the spinning or at the time of yarn joining, thereby preventing the yarn from slacking.

The take-up device 103 comprises a bobbin supported on a known cradle arm 149, a friction roller 151 making rolling contact with the bobbin (or package) to drive the bobbin to rotate, and a traverse guide 152.

When the air jet nozzles 131, 132 are arranged with the swirling directions in the first and second nozzles 135, 136 on the left and right sides set opposite to each other so that the winding directions of outer peripheral fibers of the bound spun yarns spun from the air jet nozzles 131, 132 are opposite to each other, namely, one of the spun yarns is an S twist yarn whereas the other is a Z twist yarn, it is possible to obtain a doubled yarn having better properties, as compared with a doubled yarn obtained by doubling S twist yarns or by doubling Z twist yarns, due to the mutual canceling effect of the opposite directionalities or the like.

In any way, in the spinning frame of the above example, the sliver S supplied from the can K is separated into two rows (three or more rows are possible depending on the form of the separation guide device 121) in the route at least before reaching the position of the middle rollers **105*a*, 105*b* in the drafting device 101, and the rows of slivers in the separated state are passed at least between the middle rollers 105*a*, 105*b* and the front rollers 106*a*, 106*b***, thereby being drafted.

Therefore, the two rows of slivers S1, S2 coming from the front rollers **106*a*, 106*b* are respectively drafted in desired manners, then introduced into the air jet nozzles 131, 132 to be spun as two spun yarns Y1, Y2, which are paralleled at the position of the guide plate 141 to be substantially one doubled yarn, and the doubled yarn is drawn out by the delivery roller 139** to be wound into one package P.

The spun yarns Y1, Y2 coming out of the twisting device 102 are subjected to detection of defective postions thereof by the slub catcher 143, and the yarns are cut by operating the cutter 142 as mentioned above according to the detection signal. Depending on the detection signal, the electromagnetic clutch 119 may also be turned "off", and the rotation of the back rollers **104*a*, 104*b* is stopped, whereby the spinning from the twisting device 102** is also stopped.

Namely, the yarn-cutting operation and the operation of starting and stopping the spinning are simultaneously performed for the two rows of slivers S1, S2 and yarns Y1, Y2.

In addition to the detection of the defective portion of the yarn, the slub catcher 143 is capable also of detection of the presence or absence of running of the yarn, namely, the occurrence of natural yarn breakage.

As has been described above, in the spinning frame of this example, for each unit the two spun yarns are paralleled into substantially one yarn, which is wound into one package P, which in turn is delivered onto the feeding conveyor 3 on the front side by the doffing car truck 7.

The package P delivered onto the feeding conveyor 3 is passed through the above-mentioned transfer device 85, gate conveyor 5 and yarn supply replacing device 6 to be erected on the tray 14 circulated around the two-for-one twister 2, and is supplied at appropriate time to each vacant spindle 8a, 8b of the two-for-one twister 2 by the operator or the operating robot 10. Since the yarn wound into the package P thus supplied has already been in the form of a doubled yarn obtained by doubling two yarns in each unit U of the spinning frame 1, there is naturally no need for a special doubling step by a doubler, and the finished wound package PA obtained by rewinding after twisting by use of the supplied package P is a good package, as compared to the yarn produced through the large number of conventional after-treatment steps mentioned first herein.

Namely, the yarns doubled at the position of the guide plate 141 after coming out of the air jet nozzles 131, 132 are the bound spun yarns spun through the mechanism as shown in FIG. 13 and described above, and, accordingly, at the time of doubling at the position of the guide plate 141 the open-end fibers f wound around the periphery of one of the spun yarn are twine round the other spun yarn Y1, Y2 by the residual torque thereof (FIG. 15). Therefore, the doubled yarn wound as the package P is a special doubled yarn in which the spun yarns Y1, Y2 constituting the doubled yarn are loosely intertwined with each other, unlike a doubled yarn wound by simply paralleling ordinary spun yarns. When the package P is served subsequently to the two-for-one twister 2, therefore, separation of the doubled yarns will not occur, and yarn end breakage will hardly occur. Besides, it is possible to obtain a good package free of a defective twist portion such as the so-called corkscrew twist in which one of the yarns has a portion slacked in the form of kinky thread relative to the other yarn. Moreover, in the portion shown in FIG. 15, the spun yarns Y1, Y2 intertwined with each other have a final twist of alternating S and Z twists generated by the residual torque of the open-end fibers f, the residual torque of the core fibers and the like, and the final twist also favorably restrain the separation of the yarns Y1, Y2 in the subsequent steps.

As is clear from the above description, according to embodiments of this invention, the large number of steps mentioned first herein and devices for carrying out the steps (particularly, a doubler) are omitted. Also, device or man power for transfer of the packages between such steps, operations for changing the package form for feeding the packages sequentially to the subsequent steps, and the like are omitted. Thus, efficiency of the production of yarn is remarkably enhanced according to embodiments of this invention.

The omission of man power leads to not only a reduction in cost but also prevention of deformation of the wound form or stainning of the outer-layer yarn, because the surfaces of the packages are not touched by human hands.

Furthermore, since the packages delivered from the spinning frame are transferred directly to the two-for-one twister, it is possible to minimize the transfer time and to minimize the area occupied by conveyor devices or the like necessary for the transfer.

What is claimed is:

1. A method of producing a yarn which comprises the steps of drafting and twisting a raw silver in a spinning device to form a spun yarn, taking-up at least two spun yarns in a paralleled state into the same package, and supplying the thus wound package to a device for reversing the direction of the package, reversing the direction of the package substantially 180° with the device for reversing and supplying the package from the device for reversing to a two-for-one twister disposed in continuity with the spinning device.

2. The method of producing a yarn as claimed in claim 1, wherein a spinning unit of said spinning device comprises a drafting device, a plurality of twisters, a take-up device, and a sliver separation guide device, wherein the step of twisting comprises the step of twisting a drafted sliver by air jets with each twister; wherein the step of taking-up comprises the step of taking-up a spun yarn to form a package with the take-up device; the method further comprising the step of collecting a plurality of spun yarns coming out of the twisters.

3. The method of producing a yarn which comprises the steps of:

drafting and twisting a silver, in a spinning device having a plurality of rows of twisters, a drafting device, a sliver separating guide and a take-up device, to form a plurality of spun yarns;

taking-up at least two spun yarns in a paralleled state into the same package;

supplying the thus wound package to a two-for-one twister disposed in continuity with the spinning device;

collecting a plurality of spun yarns coming out of the twisters;

wherein each twister comprises first and second nozzles which are provided with a passage and a plurality of minute air jet holes, the method further comprising the steps of:

jetting air in the tangential directions toward an interior of the passage of each nozzle;

swirling the jetted air flows in the first and second nozzles in opposite directions;

arranging the twisters such that the swirling directions in the first and second nozzles of one of the twister rows is set opposite to those of another twister row of to produce two spun yarns twisted in opposite directions to each other; and doubling the two spun yarns prior to being taken-up on a package.

4. Apparatus for producing a yarn comprising:

a spinning device for drafting and twisting a sliver to form a spun yarn and for taking-up at least two spun yarns in a paralleled state into the same package;

a two-for-one twister;

a conveyor for feeding the packages delivered from the spinning device;

a yarn supply package replacing device for supplying packages to the two-for-one twister;

a gate conveyor disposed between the conveyor and the yarn supply package replacing device; and a transfer device disposed between the conveyor for feeding the packages and the gate conveyor, the transfer device comprising a belt conveyor and a swiveling driver for driving the conveyor to swivel about a vertical axis to reverse the direction of the package thereon substantially 180°.

5. Apparatus for producing a yarn as claimed in claim 4, wherein a spinning unit of said spinning device comprises a drafting device for a sliver, in which a sliver guide for separating the sliver to a plurality of rows of slivers, a plurality of twisters for twisting said separated rows of slivers, respectively, said twister including a first and second nozzles in which swirling air flows in opposite tangential directions each other are produced to spun the sliver, and a take-up device for taking-up the produced spun yarns to form a package.

6. Apparatus for producing a yarn comprising:

a spinning device for drafting and twisting a sliver to form a spun yarn and for taking-up at least two spun yarns in a paralleled state into the same package;

a two-for-one twister;

said spinning device and said two-for-one twister being connected to each other by a conveyor for feeding the packages delivered from the spinning device and by a yarn supply package replacing device;

wherein a spinning unit of said spinning device comprises a drafting device for a sliver, in which a sliver guide for separating the sliver to a plurality of rows of slivers, a plurality of twisters for twisting said separated rows of slivers, respectively, said twister including first and second nozzles in which swirling air flows in opposite tangential directions with respect to each other to produce a spun yarn, and a take-up device for taking-up the produced spun yarns to form a package;

wherein said sliver guide for separating the sliver is a sliver separation guide device which comprises a rotating body provided between back rollers and middle rollers of the drafting device.

7. Apparatus for producing a yarn as claimed in claim 6, wherein said rotating body comprises a rotatable member having a rhombic vertical section and being rotatable at substantially the same speed and in the same direction as the back rollers.

8. Apparatus for producing a yarn comprising:

a spinning device for drafting and twisting a sliver to form a spun yarn and for taking-up at lest two spun yarns in a paralleled state into the same package;

a two-for-one twister;

said spinning device and said two-for-one twister being connected to each other by a conveyor for feeding the packages delivered from the spinning device and by a yarn supply package replacing device;

wherein a spinning unit of said spinning device comprises a drafting device for a sliver, in which a sliver guide for separating the sliver to a plurality of rows of slivers, a plurality of twisters for twisting said separated rows of slivers, respectively, said twister including first and second nozzles in which swirling air flows in opposite tangential directions with respect to each other to produce a spun yarn, and a take-up device for taking-up the produced spun yarns to form a package;

wherein a guide plate for collecting and making parallel a plurality of spun yarns fed from the twisters is disposed on an upstream side of the take-up device.

9. Apparatus for producing a yarn as claimed in claim 4, wherein said yarn supply package replacing device comprises a package receiver member, means for vertically sliding and swiveling the package receiver member, and a guide device for guiding the package and fitting the package to a cylindrical support member on a carrier for a package.

10. Apparatus for producing a yarn as claimed in claim 9, wherein said package receiver member includes a bottom plate having a groove to permit relative entrance of a bobbin of a package and a pair of empty bobbin gripping pieces are supported on the bottom plate on the opposite sides of the groove.

11. Apparatus for producing a yarn as claimed in claim 9, wherein said guide device comprises a guide rod located on an axis line of a support member which is liftably provided on an upper side of the carrier at the yarn supply package replacing position, and the guide rod is vertically moved between a waiting position and a most lowered position so that a conical portion at the lower end of the guide rod enters into a top aperature of the cylindrical support member of the carrier when the guide rod is located in the most lowered position.

* * * * *